United States Patent [19]

Bloom et al.

[11] Patent Number: 4,731,563

[45] Date of Patent: Mar. 15, 1988

[54] COLOR DISPLAY SYSTEM

[75] Inventors: Stanley Bloom, Bridgewater; Eric F. Hockings, Princeton, both of N.J.

[73] Assignee: RCA Corporation, Princeton, N.J.

[21] Appl. No.: 912,632

[22] Filed: Sep. 29, 1986

[51] Int. Cl.[4] ..... H01J 29/58; H01J 29/50; H01J 29/46

[52] U.S. Cl. ..... 315/382; 313/414; 313/444; 313/449

[58] Field of Search ..... 315/382, 382.1, 17, 315/370; 313/414, 437, 441–444, 449

[56] References Cited

U.S. PATENT DOCUMENTS

| | | | |
|---|---|---|---|
| 2,884,559 | 4/1959 | Cooper, Jr. et al. | 315/14 |
| 3,317,769 | 5/1967 | Johnson | 313/80 |
| 3,504,211 | 3/1970 | Takemoto et al. | 315/382.1 |
| 3,678,316 | 7/1972 | Barten | 313/69 C |
| 3,678,320 | 7/1972 | Barten | 313/70 C |
| 3,949,262 | 4/1976 | Ohkoshi et al. | 313/412 |
| 3,949,262 | 4/1976 | Ohkoshi et al. | 313/412 |
| 4,214,188 | 7/1980 | Bafaro et al. | 315/382 |
| 4,234,814 | 11/1980 | Chen et al. | 313/412 |
| 4,258,298 | 3/1981 | Hilburn et al. | 315/382 |
| 4,316,128 | 2/1982 | Shiratsuchi | 315/411 |
| 4,319,163 | 3/1982 | Chen | 315/14 |
| 4,366,419 | 12/1982 | Barten | 315/382 |

*Primary Examiner*—Theodore M. Blum
*Assistant Examiner*—Gregory C. Issing
*Attorney, Agent, or Firm*—Eugene M. Whitacre; Dennis H. Irlbeck

[57] ABSTRACT

A color display system includes a cathode-ray tube and self-converging yoke that produces an astigmatic magnetic deflection field within the tube. The tube has an electron gun for generating and directing three electron beams along paths toward a screen. The gun includes beam-forming region electrodes, main focusing lens electrodes, and two electrodes for forming a multipole lens between the beam-forming region and the main focusing lens in each of the electron beam paths. Each multipole lens is oriented to provide a correction to an associated electron beam to at least partially compensate for the effect of the astigmatic magnetic deflection field on that beam. A first multipole lens electrode is located between the beam-forming region electrodes and the main focusing lens electrodes. A second multipole electrode is connected to a main focusing lens electrode and located between the first multipole lens electrode and the main focusing lens, adjacent to the first multipole lens electrode. Means are included for applying a fixed focus voltage to the second multipole lens electrode and a dynamic voltage signal, related to the deflection of the electron beams to the first multipole lens electrode. Each multipole lens is located sufficiently close to the main focusing lens to cause the strength of the main focusing lens to vary as a function of voltage variation of the dynamic voltage signal.

18 Claims, 11 Drawing Figures

COLOR DISPLAY SYSTEM

The present invention relates to color display systems including cathode-ray tubes having three beam electron guns, and particularly to such guns having means therein to compensate for astigmatism of a self-converging deflection yoke used with the tube in the system.

BACKGROUND OF THE INVENTION

Although present-day deflection yokes produce a self-convergence of the three beams in a cathode-ray tube, the price paid for such self-convergence is a deterioration of the individual electron beam spot shapes. The yoke magnetic field is astigmatic, and it both overfocuses the vertical-plane electron beam rays, leading to deflected spots with appreciable vertical flare, and underfocuses the horizontal rays, leading to slightly enlarged spot width. To compensate, it has been the practice to introduce an astigmatism into the beam-forming region of the electron gun to produce a defocusing of the vertical rays and an enhanced focusing of the horizontal rays. Such astigmatic beam-forming regions have been constructed by means of G1 control grids or G2 screen grids having slot-shaped apertures. These slot-shaped apertures produce non-axially-symmetric fields with quadrupolar components which act differently upon rays in the vertical and horizontal planes. Such slot-shaped apertures are shown in U S. Pat. No. 4,234,814, issued to Chen et al. on Nov. 18, 1980. These constructions are static; the quadrupole field produces compensatory astigmatism even when the beams are undeflected and experiencing no yoke astigmatism.

To provide improved dynamic correction, U.S. Pat. No. 4,319,163, issued to Chen on March 9, 1982, introduces an extra upstream screen grid, G2*a*, with horizontally slotted apertures, and with a variable or modulated voltage applied to it. The downstream screen grid, G2*b*, has round apertures and is at a fixed voltage. The variable voltage on G2*a* varies the strength of the quadrupole field, so that the astigmatism produced is proportional to the scanned off-axis position.

Although effective, use of astigmatic beam-forming regions has several disadvantages. First, beam-forming regions have a high sensitivity to construction tolerances because of the small dimensions involved. Second, the effective length or thickness of the G2 grid must be changed from the optimum value it has in the absence of slotted apertures. Third, beam current may vary when a variable voltage is applied to a beam-forming region grid. Fourth, the effectiveness of the quadrupole field varies with the position of the beam crossover and, thus, with beam current. Therefore, it is desirable to develop astigmatism correction in an electron gun which is not subject to these disadvantages.

SUMMARY OF THE INVENTION

A color display system includes a cathode-ray tube and yoke. The yoke is a self-converging type that produces an astigmatic magnetic deflection field within the tube. The cathode-ray tube has an electron gun for generating and directing three electron beams along paths toward a screen of the tube. The electron gun includes electrodes that comprise a beam-forming region and electrodes that form a main focusing lens, and includes electrodes for forming a multipole lens between the beam-forming region and the main focusing lens in each of the electron beam paths. Each multipole lens is oriented to provide a correction to an associated electron beam to at least partially compensate for the effect of the astigmatic magnetic deflection field on the associated beam. There are two multipole lens electrodes. A first multipole lens electrode is located between the beam-forming region electrodes and the main focusing lens electrodes. A second multipole electrode is connected to a main focusing lens electrode and is located between the first multipole lens electrode and the main focusing lens, adjacent to the first multipole lens electrode. Means are included for applying a fixed focus voltage to the second multipole lens electrode, and means are included for applying a dynamic voltage signal to the first multipole lens electrode. The dynamic voltage signal is related to deflection of the electron beams. Each multipole lens is located sufficiently close to the main focusing lens to cause the strength of the main focusing lens to vary as a function of voltage variation of the dynamic voltage signal.

DETAILED DESCRIPTION OF THE PREFERRED EMBODIMENTS

Figure 1:
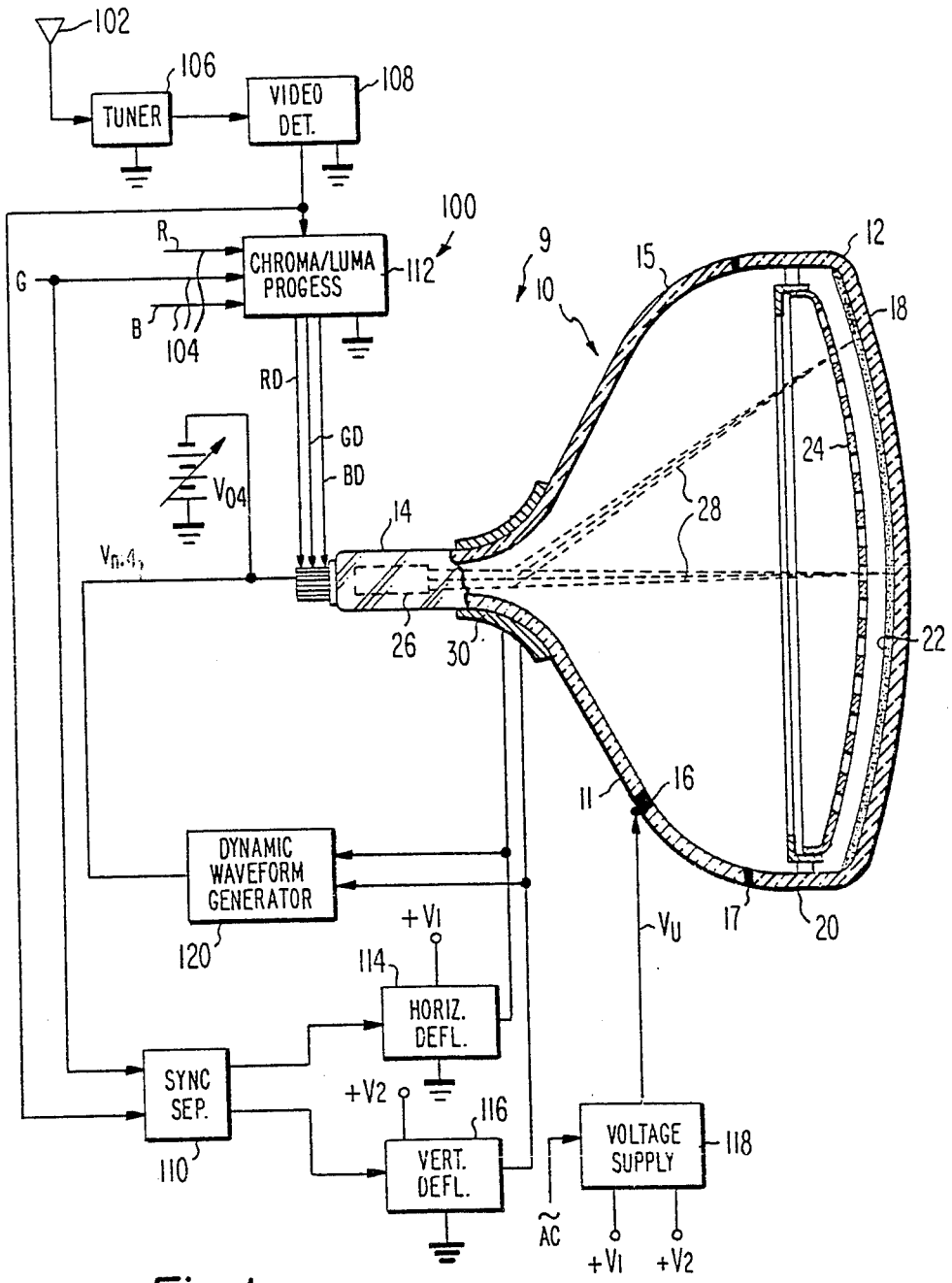
FIG. 1 is a plan view, partly in axial section, of a color display system embodying the invention.

FIG. 1 shows a color display system 9 including a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20 which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors. Alternatively, the screen can be a dot screen. A multi-apertured color selection electrode or shadow mask 24 is removably mounted, by conventional means, in predetermined spaced relation to the screen 22. An improved electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1. In the preferred embodiment, the yoke 30 produces a self-convergence of the centroids of the three electron beams at the tube mask. Such a yoke produces an astigmatic magnetic field which overfocuses the vertical-plane rays of the beams and underfocuses the horizontal-plane rays of the beams. Compensation for this astigmatism is provided in the improved electron gun 26.

FIG. 1 also shows a portion of the electronics used for exciting the tube 10 and yoke 30. These electronics are described below following a description of the electron gun 26.

Figure 2:
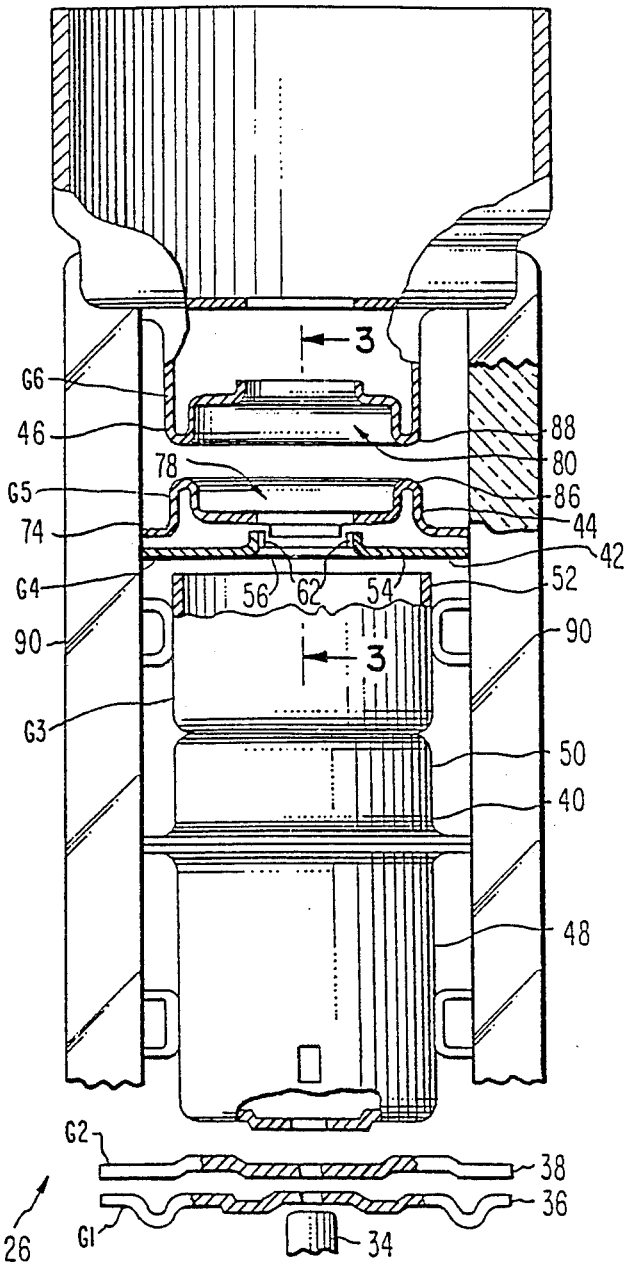
FIG. 2 is a partially cutaway axial section side view of the electron gun shown in dashed lines in FIG. 1.
Figure 3:
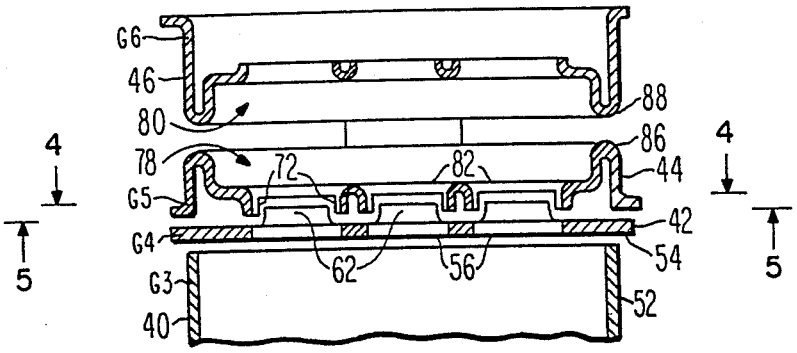
FIG. 3 is an axial section view of the electron gun taken at line 3—3 of FIG. 2.

The details of the electron gun 26 are shown in FIGS. 2 and 3. The gun 26 comprises three spaced inline cathodes 34 (one for each beam, only one being shown), a control grid electrode 36 (G1), a screen grid electrode 38 (G2), an accelerating electrode 40 (G3), a first quadrupole electrode 42 (G4), a combined second quadrupole electrode and first main focusing lens electrode 44 (G5), and a second main focusing lens electrode 46 (G6), spaced in the order named. Each of the G1 through G6 electrodes has three inline apertures located therein to permit passage of three electron beams. The electrostatic main focusing lens in the gun 26 is formed by the facing portions of the G5 electrode 44 and the G6 electrode 46. The G3 electrode 40 is formed with three cup-shaped elements 48, 50 and 52. The open ends of two of these elements, 48 and 50, are attached to each other, and the apertured closed end of the third element 52 is attached to the apertured closed end of the second element 50. Although the G3 electrode 40 is shown as a three-piece structure, it could be fabricated from any number of elements to attain the same or any other desired length.

Figure 4:
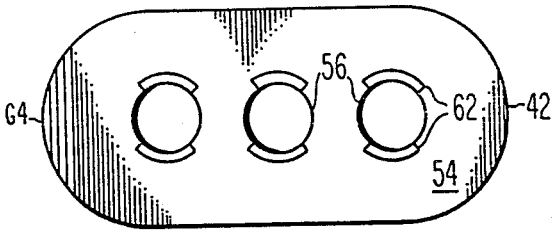
FIG. 4 is a plan view of the electron gun taken at line 4—4 of FIG. 3.

The first quadrupole electrode 42 comprises a plate 54 having three inline apertures 56 therein and castled extrusions extending therefrom in alignment with the apertures 56. Each extrusion includes two sector portions 62. As shown in FIG. 4, the two sector portions 62 are located opposite each other, and each sector portion 62 encompasses approximately 85 degrees of the circumference of a cylinder.

The G5 electrode 44 and the G6 electrode 46 are similar in construction in that they have facing ends that include peripheral rims 86 and 88, respectively, and apertured portions set back in large recesses 78 and 80, respectively, from the rims. The rims 86 and 88 are the closest portions of the two electrodes 44 and 46 to each other and have the predominant effect on forming the main focusing lens.

Figure 5:
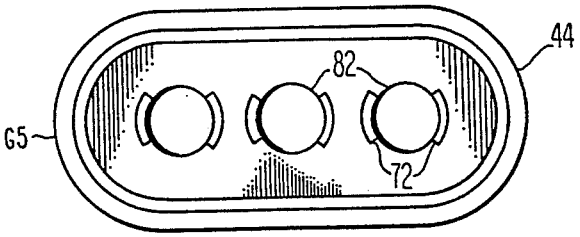
FIG. 5 is a plan view of the electron gun taken at line 5—5 of FIG. 3.

The G5 electrode 44 includes three inline apertures 82, each aperture having extrusions that extend toward the G4 electrode 42. The extrusions of each aperture 82 are formed in two sector portions 72. As shown in FIG. 5, the two sector portions 72 are located opposite each other, and each sector portion 72 encompasses approximately 85 degrees of the cylinder circumference. The positions of the sector portions 72 are rotated 90° from the positions of the sector portions 62 of the G4 electrode 42, and the four sector portions are assembled in non-touching, interdigitated fashion. Although the sector portions 62 and 72 are shown with square corners, their corners may be rounded.

All of the electrodes of the gun 26 are either directly or indirectly connected to two insulative support rods 90. The rods 90 may extend to and support the G1 electrode 36 and the G2 electrode 38, or these two electrodes may be attached to the G3 electrode 40 by some other insulative means. In a preferred embodiment, the support rods are of glass, which has been heated and pressed onto claws extending from the electrodes, to embed the claws in the rods.

Figure 6:
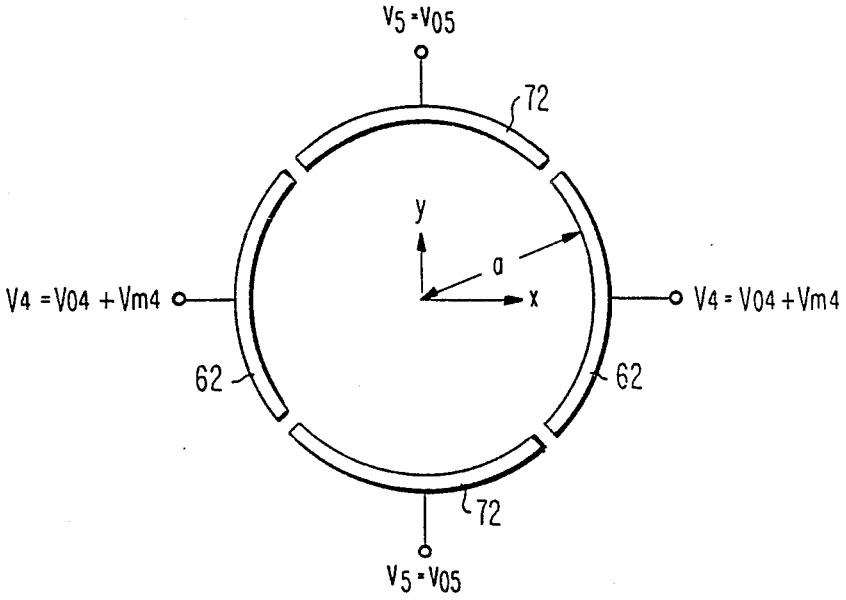
FIGS. 6 and 7 are front and side views, respectively, of a set of quadrupole lens sector portions of the electron gun of FIG. 2.
Figure 7:
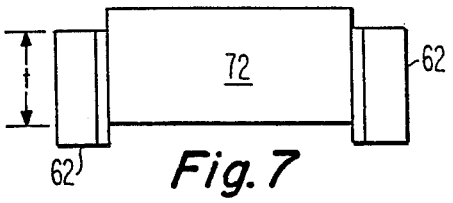

FIGS. 6 and 7 show the sector portions 62 and 72 of equal dimensions, being curved on the same radius "a" and having an overlap length "t". A voltage $V_4=V_{o4}+V_{m4}$ is applied to the sector portions 62, and a voltage $V_5=V_{o5}$ is applied to the sector portions 72. Subscript "o" indicates a D.C. voltage, and subscript "m" indicates a modulated voltage. This structure produces a quadrupolar potential, at positions x, y, $$\phi=(V_4+V_5)/2+(V_4-V_5)(x^2-y^2)/2a^2+\ldots,$$

and a transverse field, $$E_x=-(\Delta V/a^2)x=(-x/y)E_y,$$

where $$\Delta V=V_4-V_5.$$

This field deflects an incoming ray through an angle, $$\theta\simeq LE_x/2V_o,$$

where the effective length of the interaction region is $$L\simeq 0.4a+t,$$

and where the mean potential is $$V_o=(V_4+V_5)/2.$$

Thus, the paraxial focal length of this quadrupole lens is $$f_x=x/\theta\simeq[2a^2/(0.4a+t)](V_o/\Delta V)=-f_y.$$

An additional degree of control is obtainable by using a different lens radius, a, and/or length, t, for the quadrupoles around the two outer beams, as compared to those for the quadrupole around the center beam.

Figure 8:
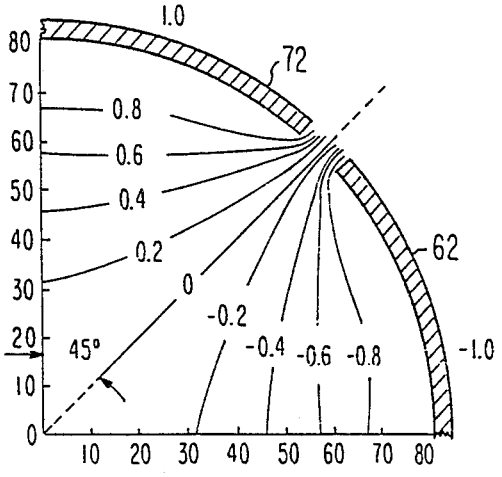
FIG. 8 is an upper right quadrant view of the quadrupole lens sector portions of FIGS. 6 and 7, showing electrostatic potential lines.

The electrostatic potential lines established by the equal sector portions 62 and 72 are shown in FIG. 8 for one quadrant. Nominal voltages of 1.0 and −1.0 are shown applied to the sector portions 72 and 62, respectively. The electrostatic field forms a quadrupole lens which has a net effect on an electron beam of compressing it in one direction and expanding it in an orthogonal direction.

The electron gun 26 includes a dynamic quadrupole lens which is located differently and constructed differently than quadrupole lenses used in prior electron guns. The new quadrupole lens includes curved plates having surfaces that lie parallel to the electron beam paths and form electrostatic field lines that are normal to the beam paths. The quadrupole lens is located between the beam-forming region and the main focusing lens, but closer to the main focusing lens. The advantages of this location are: (1) a low sensitivity to construction tolerances, (2) the effective G2 length need not be changed from the optimum value, (3) the closeness of the quadrupole to the main focusing lens produces beam bundles which are closely circular in the main lens and less likely to be intercepted by the main focusing lens, (4) the beam current is not modulated by the variable quadrupole voltage, (5) the effective quadrupole lens strength is greater the closer the quadrupole lens is to the main lens, and (6) the quadrupole lens, being separate from the main focus lens, does not adversely affect the main lens. The advantages of the new construction are: (1) the quadrupole's transverse fields are produced directly and are stronger than the transverse fields which arise indirectly, as only an accompaniment to the differential penetration of G2*b* voltages into the slot of the G2*a* in the prior tube of above-cited U.S. Pat. No. 4,319,163, (2) the absence of spherical aberration caused by the higher multipoles produced additionally by the slotted-aperture type of grid lens, and (3) self-containment, making the construction independent of adjacent electrodes.

Referring back to FIG. 1, there is shown a portion of the electronics 100 that may operate the system as a television receiver or as a computer monitor. The electronics 100 is responsive to broadcast signals received via an antenna 102, and to direct red, green and blue (RGB) video signals via input terminals 104. The broadcast signal is applied to tuner and intermediate frequency (IF) circuitry 106, the output of which is applied to a video detector 108. The output of the video detector 108 is a composite video signal that is applied to a synchronizing signal (sync) separator 110 and to a chrominance and luminance signal processor 112. The sync separator 110 generates horizontal and vertical synchronizing pulses that are, respectively, applied to horizontal and vertical deflection circuits 114 and 116. The horizontal deflection circuit 114 produces a horizontal deflection current in a horizontal deflection winding of the yoke 30, while the vertical deflection circuit 116 produces a vertical deflection current in a vertical deflection winding of the yoke 30.

In addition to receiving the composite video signal from the video detector 108, the chrominance and luminance signal processing circuit 112 alternatively may receive individual red, green and blue video signals from a computer, via the terminals 104. Synchronizing pulses may be supplied to the sync separator 110 via a separate conductor or, as shown in FIG. 1, by a conductor from the green video signal input. The output of the chrominance and luminance processing circuitry 112 comprises the red, green and blue color drive signals, that are applied to the electron gun 26 of the cathode ray tube 10 via conductors RD, GD and BD, respectively.

Power for the system is provided by a voltage supply 118, which is connected to an AC voltage source. The voltage supply 118 produces a regulated DC voltage level $+V_1$ that may, illustratively, be used to power the horizontal deflection circuit 114. The voltage supply 118 also produces DC voltage $+V_2$ that may be used to power the various circuits of the electronics, such as the vertical deflection circuit 116. The voltage supply further produces a high voltage $V_u$ that is applied to the ultor terminal or anode button 16.

Circuits and components for the tuner 106, video detector 108, sync separator 110, processor 112, horizontal deflection circuit 114, vertical deflection circuit 116 and voltage supply 118 are well known in the art and therefore not specifically described herein.

In addition to the elements noted above, the electronics 100 includes a dynamic waveform generator 120. The waveform generator 120 provides the dynamically varied voltage $V_{m4}$ to the sector portions 62 of the electron gun 26.

The generator 120 receives the horizontal and vertical scan signals from the horizontal deflection circuit 114 and the vertical deflection circuit 116, respectively. The circuitry for the waveform generator 120 may be that known from, for example: U.S. Pat. No. 4,214,188, issued to Bafaro et al. on July 22, 1980; U.S. Pat. No. 4,258,298, issued to Hilburn et al. on Mar. 24, 1981; and U.S. Pat. No. 4,316,128, issued to Shiratsuchi on Feb. 16, 1982. These patents are hereby incorporated by reference for their showings of such dynamic circuitry.

The required dynamic voltage signal is at a maximum when the electron beam is deflected to screen corner and is zero when the beam is at screen center. As the beam is scanned along each raster line, the dynamic voltage signal is varied from high to low to high in a form that may be parabolic. This parabolic signal at line rate may be modulated by another parabolic signal that is at frame rate. The particular signal utilized depends upon the design of the yoke that is used.

Principles Of Operation

Figure 9:
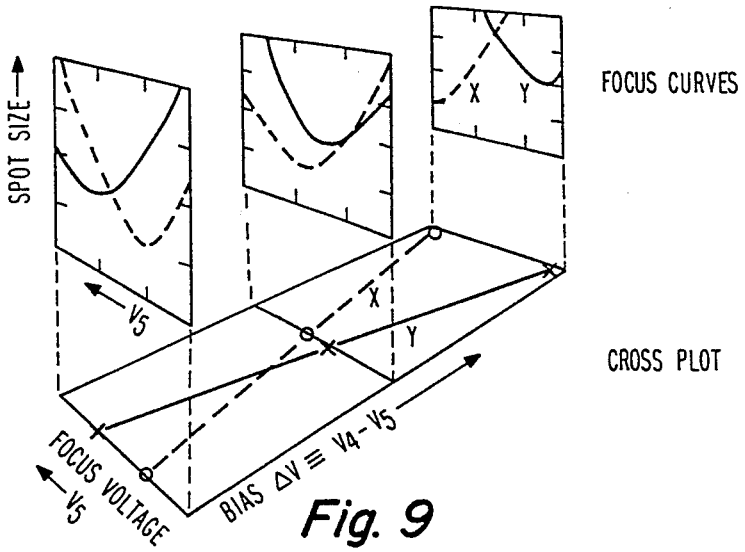
FIG. 9 is a three-dimensional perspective graph of three separate focus curves positioned relative to a cross plot of focus voltage versus bias voltage.

If, at a given position on the screen, the spot height (Y) and width (X) are measured as a function of the focus voltage, $V_5$, with the bias $\Delta V$ ($\Delta V = V_4 - V_5$) between $V_5$ and the quadrupole voltage, $V_4$, held constant, then the Y-versus-$V_5$ and X-versus-$V_5$ focus curves each exhibit a minimum, as is shown in FIG. 9. The difference between the $V_5$ value for the X-minimum and that for the Y-minimum is the astigmatism voltage at that bias value. Alternatively, the astigmatism can be measured from "cross plots", such as that shown in FIG. 9. Such plots are obtained when the focus voltage $V_5$ is set to some value, and the bias $\Delta$such as that shown in FIG. 9. Such plots are obtained when the focus voltage $V_5$ is set to some value, and the bias $\Delta V$ is changed by changing the quadrupole voltage, $V_4$. The two values of $V_4$ are noted at which the spot height and the width are each a minimum. The procedure is repeated for a range of $V_5$ values.

Figure 10:
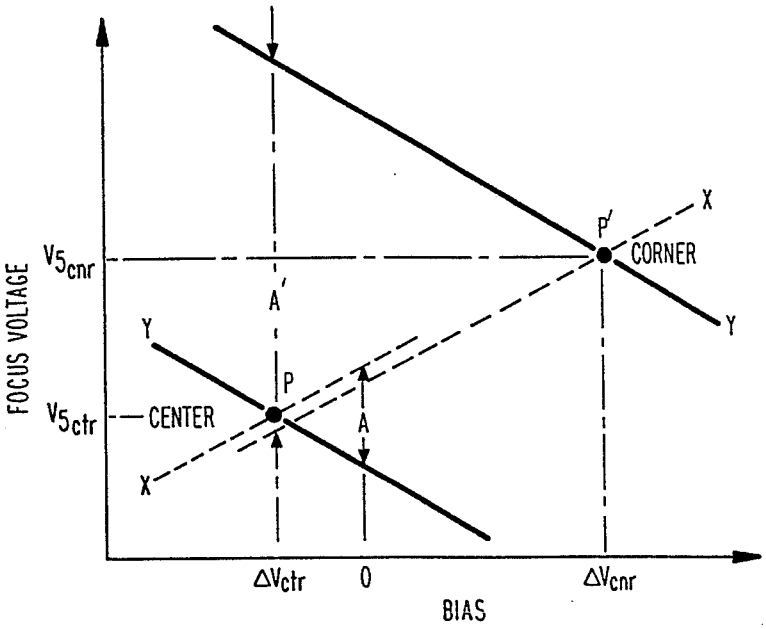
FIG. 10 is a cross plot of focus voltage versus bias voltage, showing points of zero astigmatism at the center and the corner of a screen.

When cross plots are measured for spots at both the screen center and corner, the result is generally as shown in FIG. 10, where the approximation is made that both of the X-lines (dashed) have slopes of the same magnitude as do both of the Y-lines (solid). Zero astigmatism, though not necessarily a round spot, is obtained at points P and P′ where the X-lines and Y-lines cross. At zero bias, the screen center spot height generally focuses at a lower G5 voltage than does the spot width; the difference in $V_5$ values is the gun astigmatism, A, associated with the unmodified gun. At zero bias, the screen corner spot height focuses at a much higher $V_5$ value, because the main-lens focusing must be weakened to compensate for the focusing of the vertical rays induced by the horizontal-deflection pincushion field of the self-convergent yoke. Compensation is made for the small horizontal defocusing induced by the pincushion field by a small reduction in G5 voltage, usually 50-to-100 volts. The following ignores this small reduction and takes the two dashed X-lines for the center and corner as being coincident. The difference, A', in focus voltage for the horizontal and vertical dimensions of the corner spots is the yoke astigmatism and is read from the cross plot at $\Delta V_{ctr}$, where the bias compensates for the gun astigmatism.

With the bias voltage defined as $\Delta V \equiv V_4 - V_5$ and the changes in the G4 and G5 voltages between their corner and center-screen values defined as $\delta(V_4) \equiv V_{4cnr} - V_{4ctr}$, then the slope, $S_X$, of the X-line, such as in FIG. 10, is expressible as:

$$S_X = \frac{V_{5cnr} - V_{5ctr}}{\Delta V_{cnr} - V_{ctr}} = \frac{\delta(V_5)}{\delta(V_4) - \delta(V_5)}, \quad (1)$$

whence $$\frac{\delta(V_5)}{\delta(V_4)} = \frac{S_X}{1 + S_X}.$$

Furthermore, with the slope of the Y-line denoted by $S_Y$, FIG. 10 also leads to the following expression for the yoke astigmatism:

$$A' = (S_X - S_Y)[\delta(V_4) - \delta(V_5)].$$

Thus, by Equation (1), $$\delta(V_4) = \left(\frac{1 + S_X}{S_X - S_Y}\right) A' \quad (2)$$

$$\delta(V_5) = \left(\frac{S_X}{S_X - S_Y}\right) A'.$$

The interdigitated quadrupole can be designed to operate with a positive slope for the X-lines (and, therefore, a negative slope for the Y-lines). For positive $S_X$, the north-south (i.e., vertical direction) digits are on the G4, and the east-west (i.e., horizontal direction) digits are on the G5. Then, raising $\Delta V \equiv V_4 - V_5$ makes the north-south digits more positive than the east-west and so overfocuses the rays in the horizontal plane. Restoring horizontal focus then calls for a weakening of the main lens and, therefore, a raising of the G5 voltage.

In addition to being able to control the signs of the slopes $S_X$ and $S_Y$ through the orientation of the quadrupole digits, one can control the magnitudes of the slopes through the choice of constructional dimensions. If, for the moment, any electrostatic coupling between the G4 electrode and the main-lens is neglected, then the magnitudes of $S_X$ and $S_Y$ in a cross plot are equal and given by the equation:

$$|S_X(0)| = |S_Y(0)| \simeq \quad (3)$$

$$(f - g)\left(\frac{4 \ln\sigma}{8 + \ln\sigma}\right)\left[\frac{0.6}{a}\left(0.36 + \frac{t}{a}\right)\right],$$

where $t/a > 0.30$. For $t/a < 0.30$, the last factor in Equation (3) is replaced by $$\left[\frac{1.4}{a}\left(\frac{t}{a}\right)\right] \quad (3)$$

because of changes in fringe field. Here $\sigma = V_6/V_5$ is the ratio of ultor-to-focus voltage, f is the main-lens focal length, g is the separation between the centers of the quadrupole lens and main lens, t is the overlap of the quadrupole digits, and a is the quadrupole aperture radius.

In practice, however, there is always some electrostatic coupling between the two lenses. Thus, for example, raising the voltage of a north-south G4 raises the effective G5 voltage at the main lens. This will weaken the main-lens focusing and so augment the quadrupole's vertical defocusing, while countering the quadrupole's horizontal focusing. The result is a cross plot in which the Y-lines are steeper by a certain amount than in the absence of coupling, and in which the X-lines are less steep by the same amount. This can be expressed in terms of an empirical coupling factor, $\alpha$, defined by $$V_5\,(\text{effective}) = V_5 + \alpha(V_4 - V_5) \quad (4)$$
$$= V_5 + \alpha\Delta V,$$

where $0 < \alpha < 1$. The slopes in Equation (2) are thus rewritten as:

$$S_X = S_X(0) - \alpha \quad (5)$$
$$S_Y = S_Y(0) - \alpha$$
$$S_Y(0) = -S_X(0),$$

where $S_X(0)$ is the X-line slope in the absence of coupling, and is given by Equation (3). Equations (2), (3) and (5) are used in the following design of an electron gun for single-waveform operation.

A static focus voltage, $\delta(V_5) = 0$, is obtained, as shown by Equation 2, if $S_X = S_X(0) - \alpha = 0$. The accompanying swing in quadrupole voltage is $\delta(V_4) = A'/2\alpha$ and is smaller the larger the coupling factor. A large coupling factor is obtained with small lens separation; the X-line slope is positive when the north-south digits are on the G4 electrode; and the slope magnitude, $S_X(0)$, is adjusted to equal $\alpha$ by choice of dimensions.

An interdigitated quadrupole was incorporated into a 26V110° tube having an electron gun as shown in FIG. 2. The separation, g, between midplanes of the quadrupole lens and the main lens was 4.09 mm (0.161"). The lengths of the G4 and G5 sector portions 62 and 72, respectively, were such that the overlap length, t, was 0.178 mm (0.007").

Figure 11:
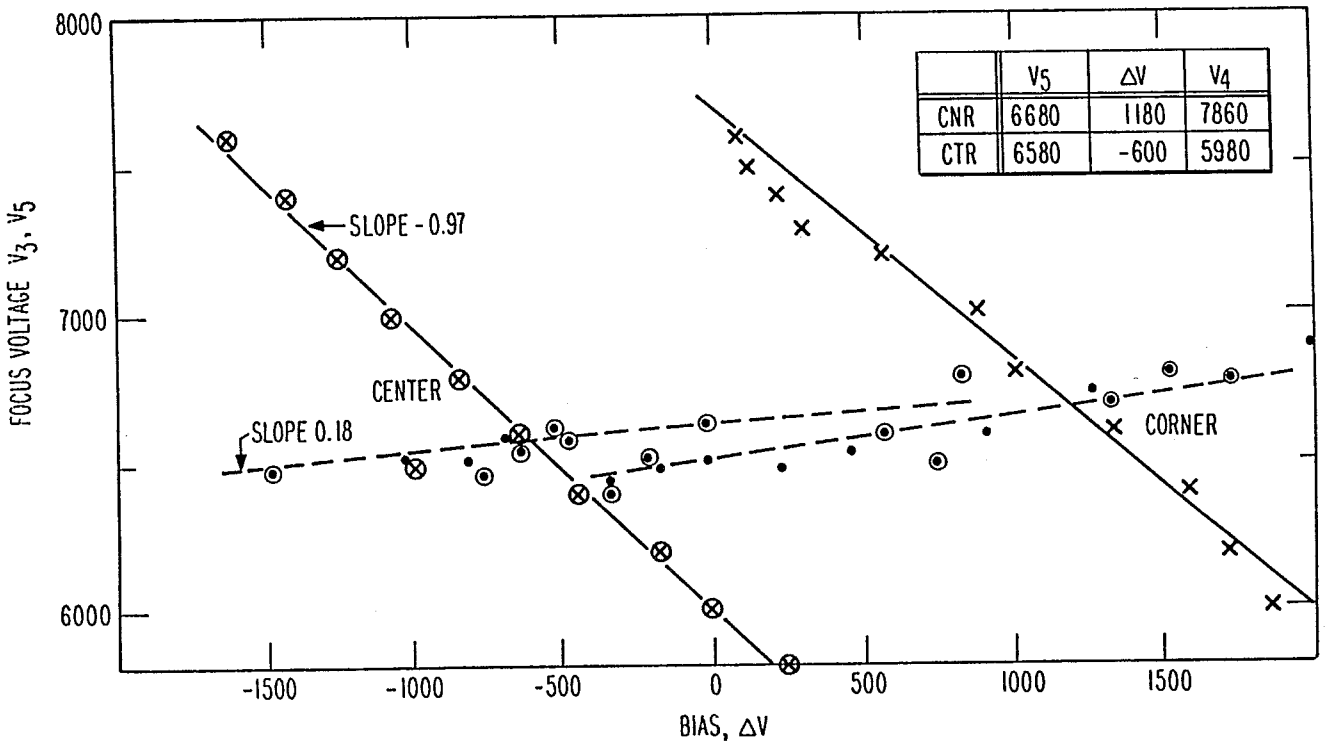
FIG. 11 is a cross plot, similar to the cross plot of FIG. 10, showing data collected from operating an actual electron gun.

The measured cross plots at the screen center and corner are shown in FIG. 11. The table shows that the G5 voltage at the center and corner zero-astigmatism operating points is constant to better than 1.5% of its value. The accompanying swing in G4 voltage is $\delta(V_4) \simeq 1880V$.

The coupling factor and the X-line slope for zero coupling can be estimated from the measured slopes of the X and Y lines at screen center, shown in FIG. 11. Thus, inserting $S_X \simeq 0.18$ and $S_Y \simeq -0.97$ into Equation (5) results in $\alpha \simeq 0.40$ and $S_X(0) \simeq 0.58$. The value of $\alpha$ also may be inferred as follows: the measured swing in G4 voltage, $\delta(V_4) \simeq 1880V$, should be equal to $A'/2\alpha$.

Thus, if the measured value of $A' \simeq 8230-6580=1650$ (at the bias $\Delta V=-600$ which removes the main-lens astigmatism) is read from FIG. 11, then $\alpha \simeq 1650/2 \times 1880 \simeq 0.44$. This agrees with the previous estimate.

The value of the X-line slope for zero coupling inferred from FIG. 11, $S_X(0)$ is 0.58. The value of $S_X(0)$ also may be inferred as follows: insertion of the values f=19.05 mm (0.750″), g =4.09 mm (0.161″), $\sigma=25{,}000/6600=3.79$, a=2.03 mm (0.080″), and t=0.178 mm (0.007″) into Equation (3) yields a calculated value of $S_X(0) \simeq 0.52$.

What is claimed is:

1. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths wherein each multipole lens is oriented to provide a correction to an associated electron beam to at least partially compensate for the effect of the astigmatic magnetic deflection field on the associated beam, and wherein said electrodes for forming a multipole lens include a first multipole lens electrode and a second multipole lens electrode, said second multipole lens electrode being a portion of one of said electrodes for forming a main focusing lens, and said first multipole lens electrode being located between the second multipole lens electrode and the beam-forming region, adjacent to the second multipole lens electrode, means for applying a fixed focus voltage to said second multipole lens electrode, means for applying a dynamic voltage signal to said first multipole lens electrode, said dynamic voltage signal being related to deflection of the electron beams, and each multipole lens being located sufficiently close to the main focusing lens to cause the strength of the main focusing lens to vary as a function of voltage variation of said dynamic voltage signal.

2. The system as defined in claim 1, wherein the strength of said main focusing lens is decreased with an increase in voltage of said dynamic voltage signal.

3. The system as defined in claim 1, wherein said multipole lens is formed by facing interdigitated portions of said first and second multipole lens electrodes.

4. The system as defined in claim 3, wherein said multipole lens is a quadrupole lens.

5. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths, wherein each multipole lens is oriented to provide a correction to an associated electron beam to at least partially compensate for the effect of the astigmatic magnetic deflection field on the associated beam, and wherein said electrodes for forming a multipole lens include a first multipole lens electrode and a second multipole lens electrode, said second multipole lens electrode being a portion of one of said electrodes for forming a main focusing lens, and said first multipole lens electrode being located between the second multipole lens electrode and the beam-forming region, adjacent to the second multipole lens electrode, means for applying a fixed focus voltage to said second multipole lens electrode, means for applying a dynamic voltage signal to said first multipole lens electrode, said dynamic voltage signal being related to deflection of the electron beams, and said multipole lens being located sufficiently close to said main focusing lens to effectively couple the dynamic voltage signal applied to the first multipole lens electrode to the second multipole lens electrode, whereby the focus voltage on the second multipole lens electrode is effectively varied, although not actually varied, with voltage variation in the dynamic voltage signal.

6. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths, wherein each multipole lens is oriented to provide a correction to an associated electron beam to at least partially compensate for the effect of the astigmatic magnetic deflection field on the associated beam, and wherein said electrodes for forming a multipole lens include a first multipole lens electrode and a second multipole lens electrode, said second multipole lens electrode being a portion of one of said electrodes for forming a main focusing lens, and said first multipole lens electrode being located between the second multipole lens electrode and the beam-forming region, adjacent to the second multipole lens electrode, means for applying a fixed focus voltage to said second multipole lens electrode, means for applying a dynamic voltage signal to said first multipole lens electrode, said dynamic voltage signal being related to deflection of the electron beams, and each multipole lens being located sufficiently close to said main focusing lens to affect the strength of said main focusing lens as the voltage on the first multipole lens electrode is varied.

7. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths, wherein each multipole lens is oriented to provide a correction to an associated electron beam to at least partially compensate for the effect of the astigmatic magnetic deflection field on the associated beam, and wherein said electrodes for forming a multipole lens include a first multipole lens electrode and a second multipole lens electrode, said second multipole lens electrode being a portion of one of said electrodes for forming a main focusing lens, and said first multipole lens electrode being located between the second multipole lens electrode and the beam-forming region, adjacent to the second multipole lens electrode, means for applying a fixed focus voltage to said second multipole lens electrode, means for applying a dynamic voltage signal to said first multipole lens electrode, said dynamic voltage signal being related to deflection of the electron beams, and said multipole lens being formed by facing interdigitated portions of said first and second multipole electrodes, the interdigitated portion of said second multipole lens electrode being extrusions about apertures of the second multipole lens electrode that form a portion of the main focusing lens.

8. In a color display system including a cathode-ray tube having an electron gun for generating and directing three inline electron beams along paths toward a screen of said tube, said gun including electrodes comprising a beam-forming region and electrodes for forming a main focusing lens, and said system including a self-converging yoke that produces an astigmatic magnetic deflection field, the improvement comprising said electron gun including three inline cathodes and six electrodes designated G1, G2, G3, G4, G5 and G6 spaced from said cathodes in the order named, said cathodes, G1, G2 and a portion of said G3 facing the G2 comprising said beam-forming region and said G5 and G6 forming said main focusing lens, said G4 and G5 electrodes forming a multipole lens in each of the electron beam paths, wherein each multipole lens is oriented to provide a correction to an associated electron beam to at least partially compensate for the effect of the astigmatic magnetic deflection field on the associated beam, means for applying a fixed focus voltage to said G3 and G5 electrodes, means for applying a dynamic voltage signal to said G4 electrode, said dynamic voltage signal being related to deflection of the electron beams, each multipole lens being located sufficiently close to the main focusing lens to cause the strength of the main focusing lens to decrease with increase in voltage of said dynamic voltage signal.

9. The system as defined in claim 8, wherein said multipole lens is a quadrupole lens.

10. The system as defined in claim 9, wherein said quadrupole lens is formed by facing interdigitated portions of said G4 and G5 electrodes.

11. The system as defined in claim 10, wherein the interdigitated portion of said G5 electrode is formed by extrusions extending from apertures on the G5 electrode that form part of the main focusing lens.

12. In an electron gun for generating and directing three electron beams along paths toward a screen of said tube, said gun including electrodes comprising a beam-forming region and electrodes for forming a main focusing lens, the improvement comprising electrodes in said electron gun for forming a multipole lens between the beam-forming region and the main focusing lens in each of the electron beam paths, wherein said electrodes for forming a multipole lens include a first multipole lens electrode and a second multipole lens electrode, said second multipole lens electrode being a portion of one of said electrodes for forming said main focusing lens, and said first multipole lens electrode being located between the second multipole lens electrode and the beam-forming region, adjacent to the second multipole lens electrode, and each multipole lens being located sufficiently close to the main focusing lens to cause the strength of the main focusing lens to vary in relation to the strength of said multipole lens.

13. The electron gun as defined in claim 12, wherein said multipole lens is formed by facing interdigitated portions of said first and second multipole lens electrodes.

14. The electron gun as defined in claim 13, wherein said multipole lens is a quadrupole lens.

15. In an electron gun for generating and directing three electron beams along paths toward a screen of said tube, said gun including electrodes comprising a beam-forming region and electrodes for forming a main focusing lens, the improvement comprising electrodes in said electron gun for forming a multipole lens between the beam-forming region and the main focusing lens in each of the electron beam paths, wherein said electrodes for forming a multipole lens include a first multipole lens electrode and a second multipole lens electrode, said second multipole lens electrode being a portion of one of said electrodes for forming a main focusing lens, and said first multipole lens electrode being located between the second multipole lens electrode and the beam-forming region, adjacent to the second multipole lens electrode, and said multipole lens being located sufficiently close to said main focusing lens to effectively couple any signal applied to the first multipole lens electrode to the second multipole lens electrode, whereby a focus voltage on the second multipole lens electrode is effectively varied, although not actually varied, with voltage variation on the first multipole lens electrode.

16. In an electron gun for generating and directing three inline electron beams along paths, said gun including electrodes comprising a beam-forming region and electrodes for forming a main focusing lens, the improvement comprising said electron gun including three inline cathodes and six electrodes designated G1, G2, G3, G4, G5 and G6 spaced from said cathodes in the order named, said cathodes, G1, G2 and a portion of said G3 facing the G2 comprising said beam-forming region and said G5 and G6 forming said main focusing lens, said G4 and G5 electrodes forming a multipole lens in each of the electron beam paths, said multipole lens being formed by facing interdigitated portions of said G4 and G5 electrodes, each multipole lens being located sufficiently close to the main focusing lens to cause the strength of the main focusing lens to decrease with increase in voltage applied to the G4 electrode.

17. The electron gun as defined in claim 16, wherein said multipole lens is a quadrupole lens.

18. The electron gun as defined in claim 16, wherein the interdigitated portion of said G5 electrode is formed by extrusions extending from apertures on the G5 electrode that form part of the main focusing lens.

* * * * *

UNITED STATES PATENT AND TRADEMARK OFFICE
CERTIFICATE OF CORRECTION

PATENT NO. : 4,731,563

DATED : March 15, 1988

INVENTOR(S) : Stanley Bloom et al.

It is certified that error appears in the above-identified patent and that said Letters Patent is hereby corrected as shown below:

Column 6, Lines 45-47 - delete the following, "Δsuch as that shown in FIG. 9. Such plots are obtained when the focus voltage $V_5$ is set to some value, and the bias".

Signed and Sealed this
Eighth Day of November, 1988

*Attest:*

*Attesting Officer*

DONALD J. QUIGG

*Commissioner of Patents and Trademarks*